US005406729A

United States Patent [19]

Bejin

[11] Patent Number: 5,406,729

[45] Date of Patent: Apr. 18, 1995

[54] ILLUMINATED DISPLAY

[75] Inventor: Jeffrey M. Bejin, Lathrup Village, Mich.

[73] Assignee: Lettertech, Inc., Lathrup Village, Mich.

[21] Appl. No.: 60,445

[22] Filed: May 12, 1993

[51] Int. Cl.[6] ..... G09F 13/00; A63H 3/12

[52] U.S. Cl. ..... 40/433; 40/474; 40/495; 446/321; 446/389; 446/392; 446/395

[58] Field of Search ..... 40/433, 435, 474, 495; 446/147, 219, 321, 389, 392, 395, 484

[56] References Cited

U.S. PATENT DOCUMENTS

| | | | |
|---|---|---|---|
| 1,550,374 | 8/1925 | Lines . | |
| 2,050,551 | 8/1936 | Armstrong et al. | 40/433 |
| 2,196,424 | 4/1940 | Musaphia . | |
| 2,441,333 | 5/1948 | Reinsberg | 446/147 |
| 2,513,100 | 6/1950 | Muri | 40/435 |
| 3,184,872 | 5/1965 | Way . | |
| 3,640,011 | 2/1972 | Fukumitsu | 40/433 X |
| 3,679,888 | 7/1972 | Reiback | 40/435 X |
| 4,277,911 | 7/1981 | Mizoule et al. | 446/389 X |
| 4,798,556 | 1/1989 | Vicars et al. | 446/392 X |

*Primary Examiner*—Edward K. Look
*Assistant Examiner*—Hoang Nguyen
*Attorney, Agent, or Firm*—Alex Rhodes

[57] ABSTRACT

An electrically illuminated advertising display for continuously exhibiting consumer products in a range of colors. The advertising display has a light source in the interior of a housing; a translucent screen forming the front portion of the housing, at least one rotatable disk interposed between the translucent screen and the light source, at least one light conducting element interposed between the translucent screen and the rotating disk, and a small fractional horsepower motor for continuously rotating the disk. The translucent screen has a thin outer photographic film with a translucent base layer and a clear transparent sheet which is bonded at its outer edges to the photographic film. One end portion of the light conducting element is bonded to a clear plastic sheet behind the photographic film and has a shape which corresponds to a portion of an image on the photographic film. The rotating disk has an arrangement of filters for projecting a range of colors via the light conducting element on to the translucent screen.

12 Claims, 7 Drawing Sheets

ILLUMINATED DISPLAY

FIELD OF THE INVENTION

This invention relates to illuminated displays and more particularly to an electrically illuminated advertising display for continuously exhibiting optional shades and colors of consumer products.

BACKGROUND OF THE INVENTION

Color is an important attribute in the sale and selection of many consumer products, especially articles of personal adornment, such as, contact lenses, eyeglasses, cosmetics, jewelry, clothing and the like. These articles are generally available in optional shades and colors. Color advertising displays are desirable because they attract a great deal of public attention and contribute to sales.

SUMMARY OF THE INVENTION

The present invention is an illuminated window or counter advertising display for exhibiting consumer products.

One object of the invention is to provide a new and improved illuminated display which is adaptable to continuously exhibit a variety of consumer products in optional shades and colors.

Another object, in addition to the foregoing object, is to provide an illuminated display for continuously exhibiting optional shades and colors of optical contact lenses.

Another object, in addition to the foregoing objects, is to provide a novel illuminated display which is eye catching and maintains the interest of an observer.

These and other objects are attained by providing display members which focus and transmit a light beam on to an image of a product on a translucent screen. Interposed between an end of a light source and the translucent screen is a rotating disk having an arrangement of color filters which continuously vary the color of an image of the product on the screen as the filter passes the image. A light conducting element between the filter and rotating element focuses the light and illuminates the image of the product on the screen.

Further objects, benefits and features of the invention will be apparent from the ensuing description and accompanying drawings which describe the invention in detail. A preferred embodiment is disclosed in accordance with the best mode which is contemplated for practicing the invention and the specific features in which exclusive property rights are claimed are set forth in each of the numbered claims which are appended to the detailed description.

DETAILED DESCRIPTION OF THE PREFERRED EMBODIMENT

Figure 2:
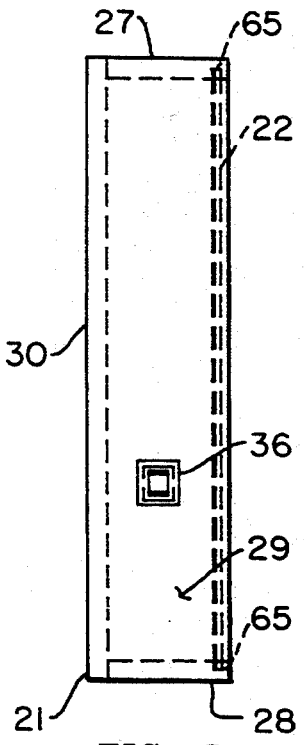
FIG. 2 is a right side view of the display.
Figure 1:
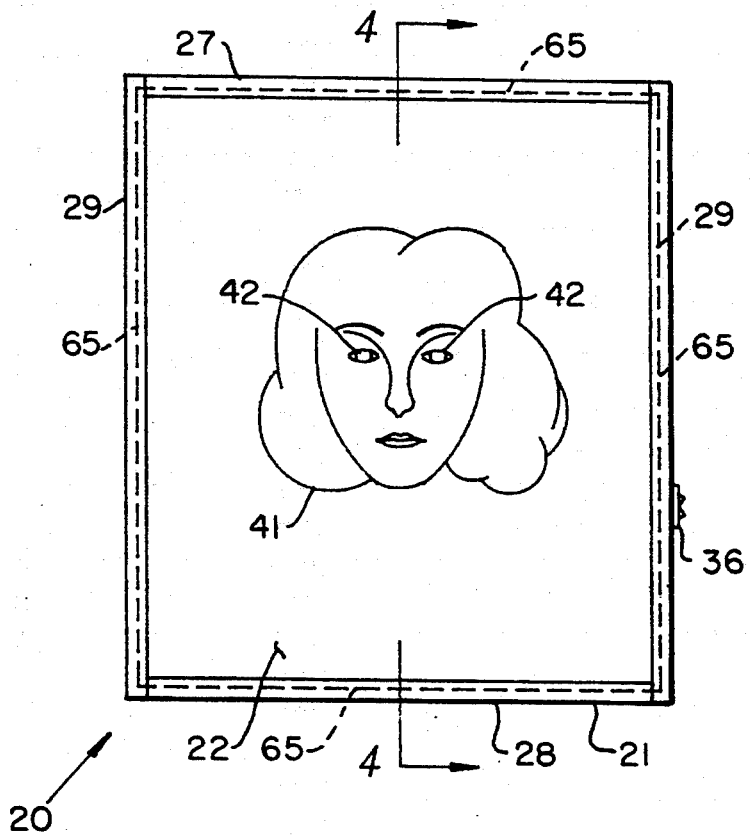
FIG. 1 is a front view of an electrically illuminated advertising display for continuously exhibiting optional colors of contact lenses.

Referring now to the drawings wherein like numerals designate like and corresponding parts throughout the several views, in FIGS. 1 through 9, inclusive, an electrically illuminated display for advertising contact lenses is shown which embodies the present invention.

The display, generally designated by the numeral 20, which produces a continuous display of optional contact lenses of color is comprised of a housing 21, a translucent screen 22, a pair of light conducting elements 49, a light source 24, a rotatable disk 25, and a drive motor 26.

Figure 4:
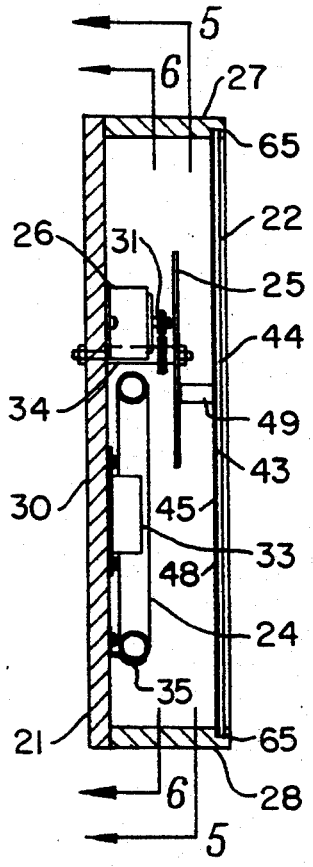
FIG. 4 is a cross-sectional view taken on the line 4—4 in FIG. 1.
Figure 3:
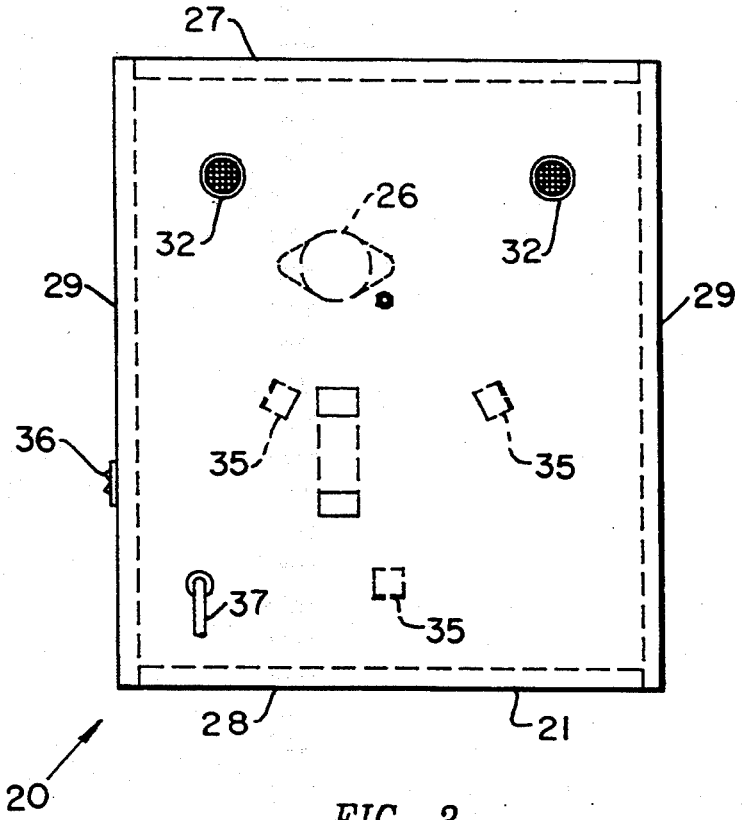
FIG. 3 is a rear view of the display.
Figure 6:
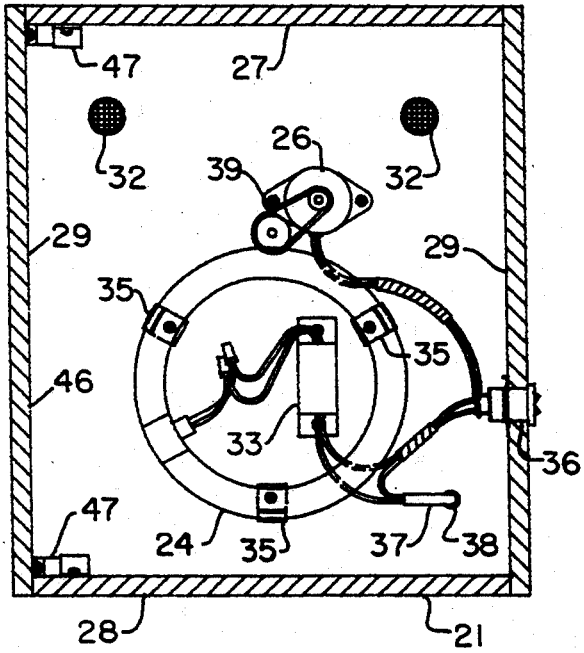
FIG. 6 is a cross-sectional view taken on the line 6—6 in FIG. 4.
Figure 5:
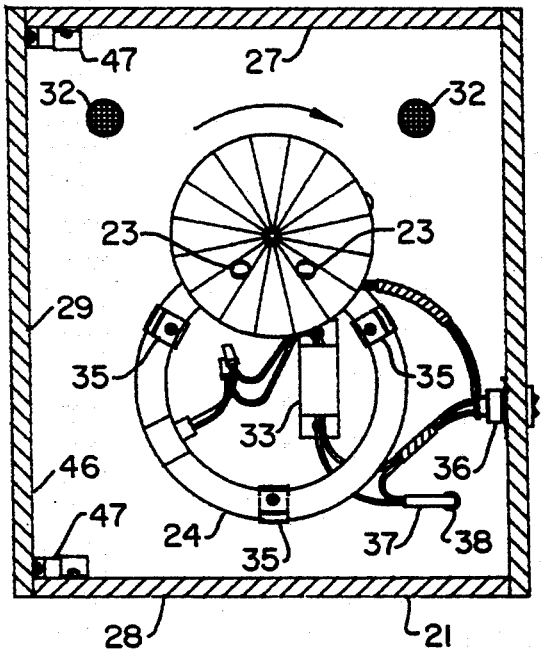
FIG. 5 is a cross-sectional view taken on the line 5—5 in FIG. 4.

The arrangement of parts which produces the continuous display of optional colors can be readily understood by an examination of FIGS. 4 through 6. The housing 21 has a horizontal top wall 27, a horizontal bottom wall 28, a pair of vertical side walls 29, and a vertical back wall 30. The drive motor 26 is horizontally mounted on the back wall 30 and has an output shaft 31 extending toward the front of the housing 21. In the back wall 30 are ventilating holes 32 which convect heat outward from the interior of the housing 21. Also mounted on the back wall 30 is the light source, a circular fluorescent light 24, a ballast 33 and a horizontal shaft 34. The fluorescent light 24 is retained to the back wall 30 with three resilient clips 35.

The fluorescent light 24 is a conventional AC circline type light and is electrically in series with the ballast 33, an "on" and "off" SPST switch 36 and a line cord 37. The line cord 37 passes out of the housing 21 through an aperture 38 in the back wall 30.

The inside surfaces of the top 27, bottom 28, back 30 and side 29 walls are preferably finished in a truly white enamel which will not yellow with age. The horizontal shaft 34 extends forwardly from its attachment to the back wall 30 toward the front of the housing 21. The rotatable disk 25 is rotatably mounted on an end portion of the shaft 34 and is operatively connected to the drive motor 26 by a resilient belt 39. The motor 26 is a conventional fractional horsepower AC gearmotor and revolves at a speed of about ½ rpm.

The rotatable disk 25 which is mounted on the inner end of the shaft 34 is a thin transparent plastic disk about 1/16 inch thick. On the front face of the disk 25 are sixteen triangular shaped light conducting filters 40. The filters which are applied to the disk by silk screening or some other suitable process consist of four identical groups, each having four different colors, A,B,C,D. The colors alternate in the same pattern, whereby a pair of the colors are provided every ninety degrees E.

The translucent screen 22 extends across the front of the housing 21 and on the screen there is an image 41 of a woman wearing a pair of contact lenses 42. The screen 22 is comprised of a rectangular sheet of photographic film 43 which is sandwiched between clear acrylic front 44 and rear 45 plastic sheets. The outer edges of the photographic film 43 are preferably bonded to the rear acrylic sheet 45 with a clear cement, such as Kodak Display Cement, to accurately position the film 43 in the display 20. The translucent screen 22 is retained in grooves 65 which extend around front portions of the top wall 27, bottom wall 28, side walls 29 and back wall 30.

The right side wall 46 is retained to the top 27 and bottom 28 walls with two resilient clips 47 and is removable for servicing the light 24, the ballast 33, the switch 36 and the translucent screen 22. When the right side wall 46 is removed, the translucent screen 22 can be slideably removed for access to the interior of the housing 21.

The fluorescent light 24 is positioned in the housing 21 such that portions of the fluorescent light cross the exposed portions 42 of the woman's eyes. The photographic film 43 has a white translucent base layer 48. If used outdoors, the screen 22 should preferably face in a northerly direction and be laminated on both sides with UV protection.

One suitable photographic film 43 is manufactured by the Eastman Kodak Company of Rochester, New York and sold under the trademark DURATRANS. DURATRANS has a white translucent base layer which diffuses light throughout the film giving a brilliant display.

Figure 7:
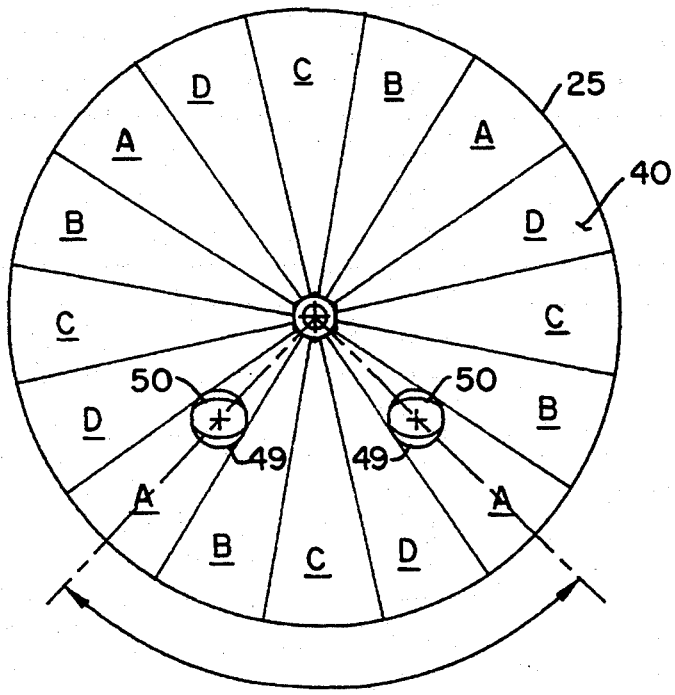
FIG. 7 is an enlarged view of the light filter disk and the pair of light conducting elements shown in FIG. 5.
Figure 8:
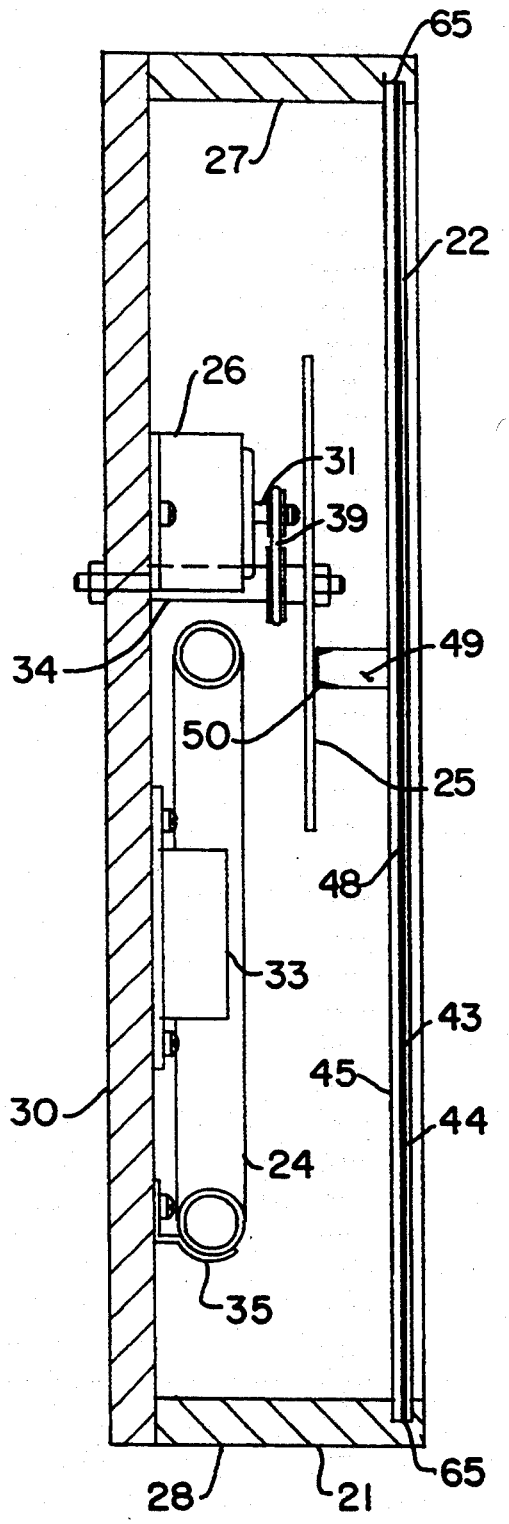
FIG. 8 is an enlarged view of FIG. 4.
Figure 9:
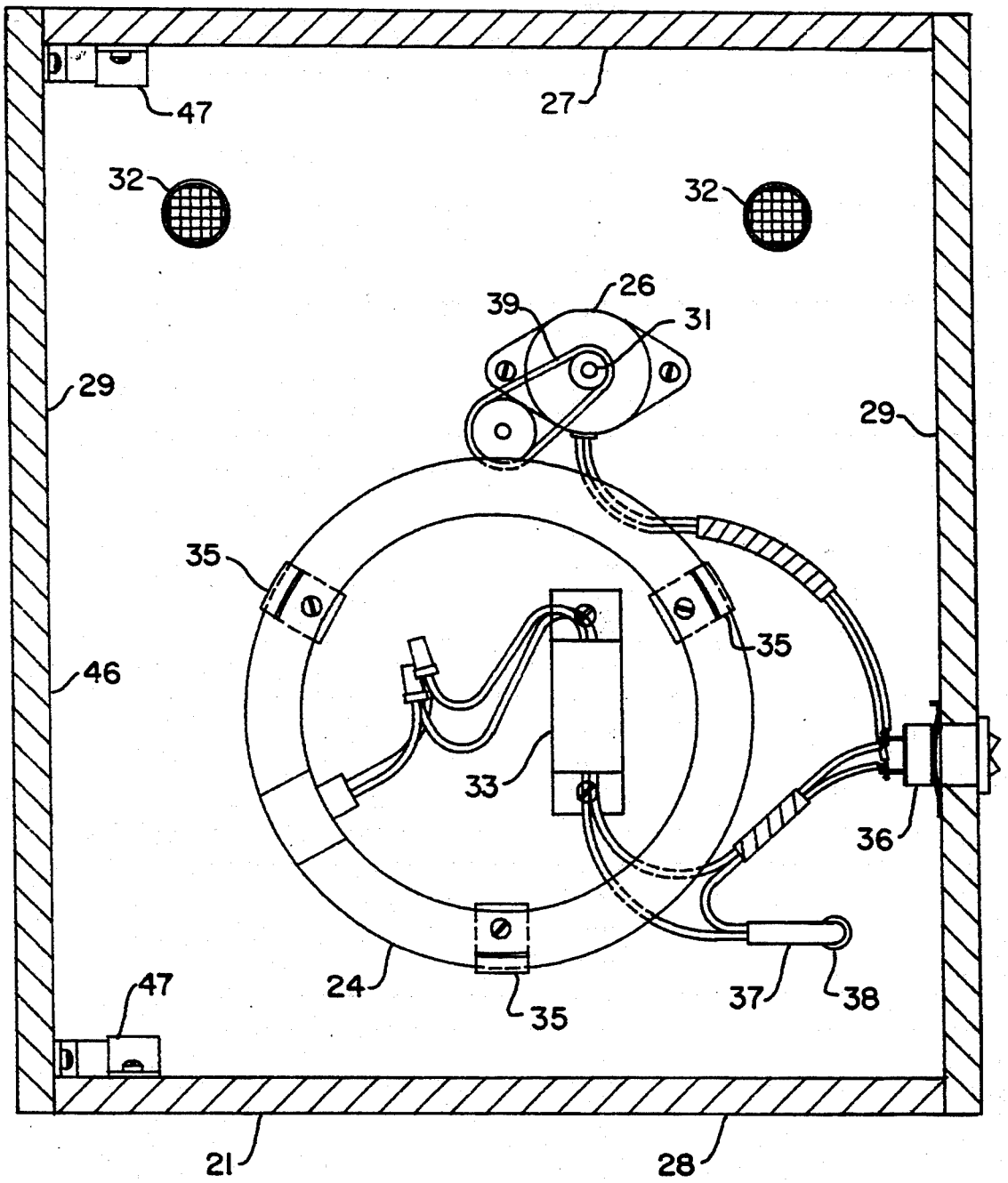
FIG. 9 is an enlarged view of FIG. 6
Figure 11:
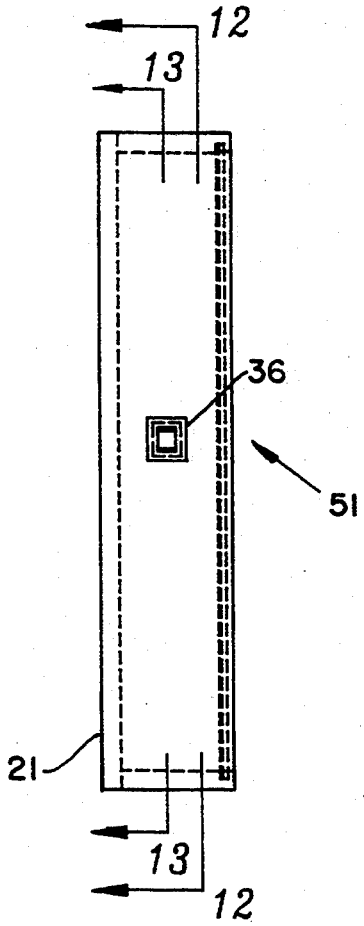
FIG. 11 is a right side view of the embodiment shown in FIG. 10.
Figure 10:
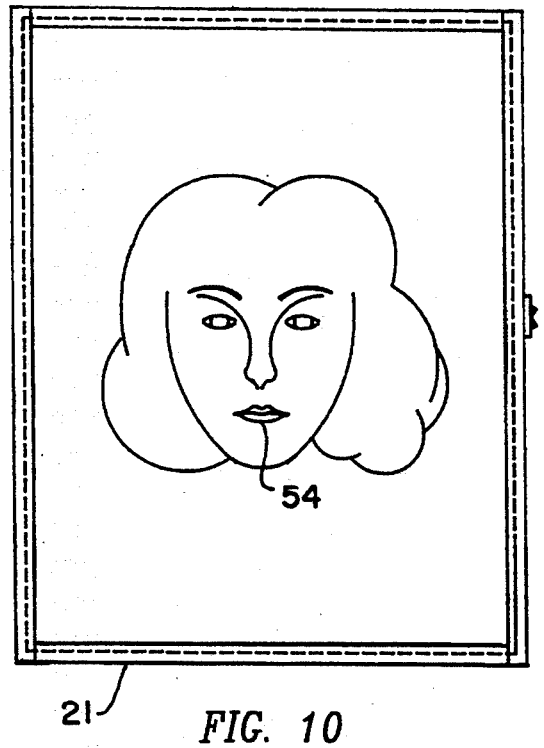
FIG. 10 is a front view of an alternate embodiment for continuously exhibiting optional colors of ladies' lipstick.
Figure 13:
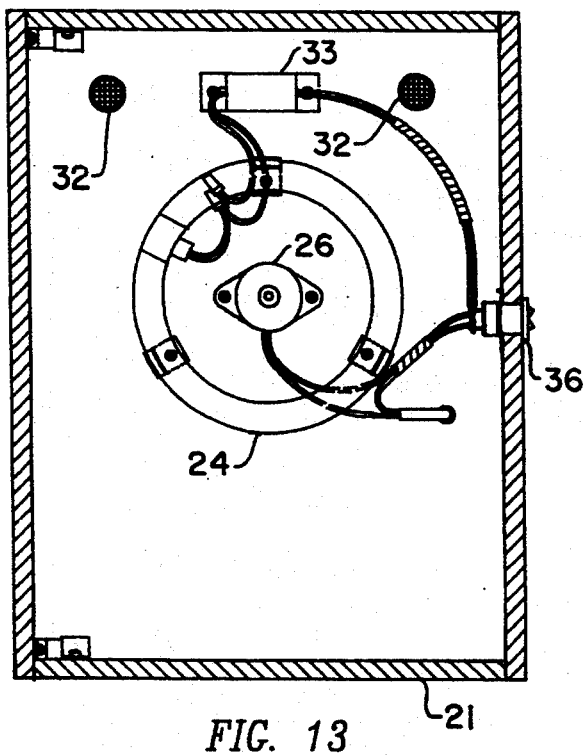
FIG. 13 is a cross-sectional view taken on the line 13—13 in FIG. 11.
Figure 12:
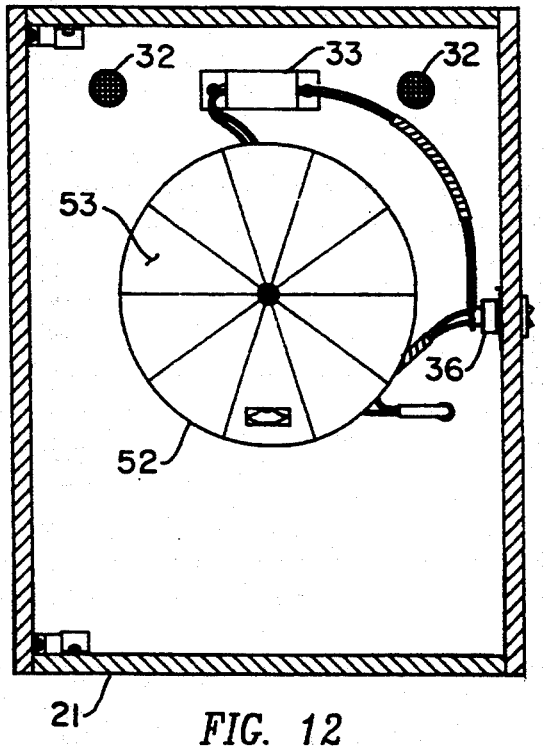
FIG. 12 is a cross-sectional view taken on the line 12—12 in FIG. 11.

Interposed between the acrylic sheet 44 of the translucent screen 22 and the rotatable filter disk 25 is a pair of elongated cylinders 49 made of clear transparent acrylic or some other suitable light conducting material. The light conducting cylinders 49 are adhesively bonded to the rear acrylic sheet 45 with a clear cement and extend inwardly to within ⅛ to ¼ inch of the filter disk 25. As best seen in FIG. 7, the end portions 50 of the light conducting cylinders 49 are tapered to match the outlines 42 of the exposed portions of the woman's eyes.

The positions of light conducting cylinders 49 in relation to the filters 40 insures that as the disk 25 is caused to rotate by the motor, at each 22 ½ degrees of rotation, the color of the woman's eyes undergoes a color change. Thus, as can be seen in FIG. 7, the included angle E from the center of rotation of the filter disk is 90 degrees.

Referring now to FIGS. 10 through 14, inclusive, an alternate embodiment 51 is shown for continuously displaying optional colors of women's lipstick. In this embodiment, a rotatable filter disk 52 containing ten equal filters of different colors is directly driven by the motor 26 repositioned and mounted to the back wall 30 of the housing 21. Thus at each 36 degrees of disk rotation, the lipstick 54 undergoes a color change.

Figure 14:
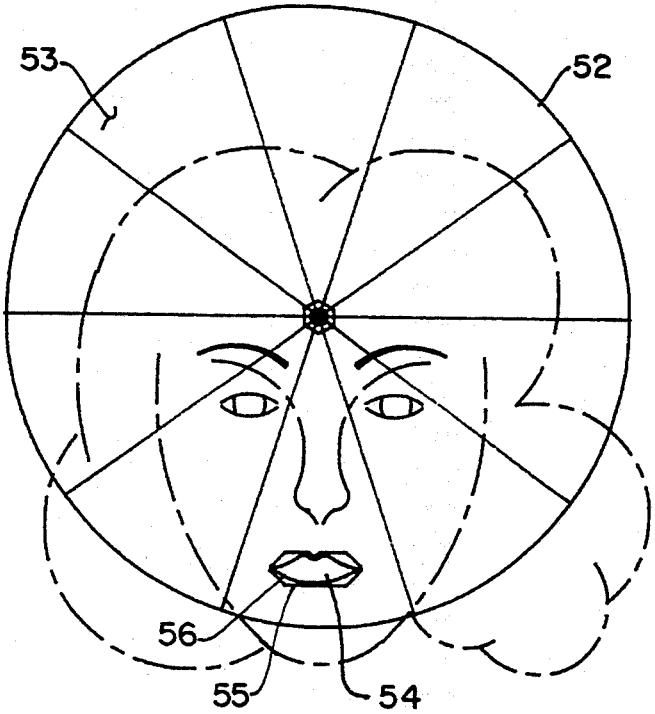
FIG. 14 is an enlarged view of the filter disk, light conducting element and the image of the woman of the embodiment shown in FIGS. 11 through 13.
Figure 16:
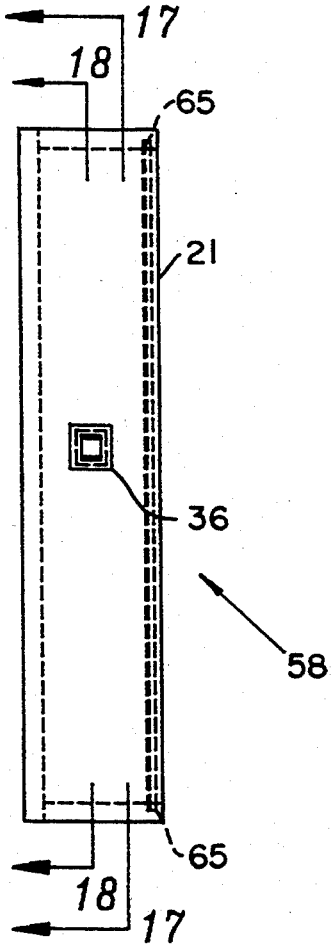
FIG. 16 is a right side view of the embodiment shown in FIG. 15.
Figure 15:
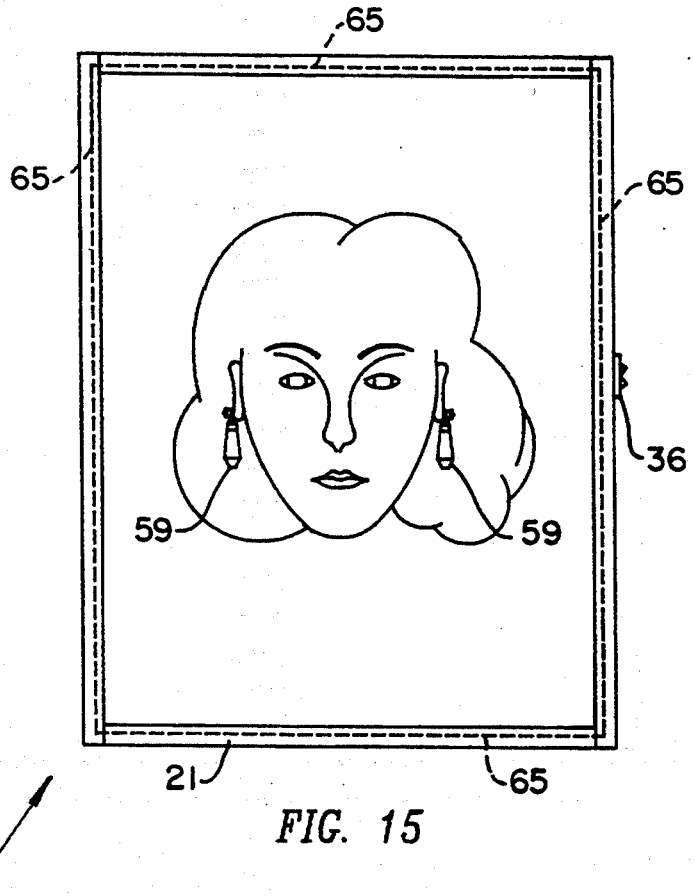
FIG. 15 is a front view of an alternate embodiment for continuously exhibiting optional colors of a pair of ladies' earrings.
Figure 18:
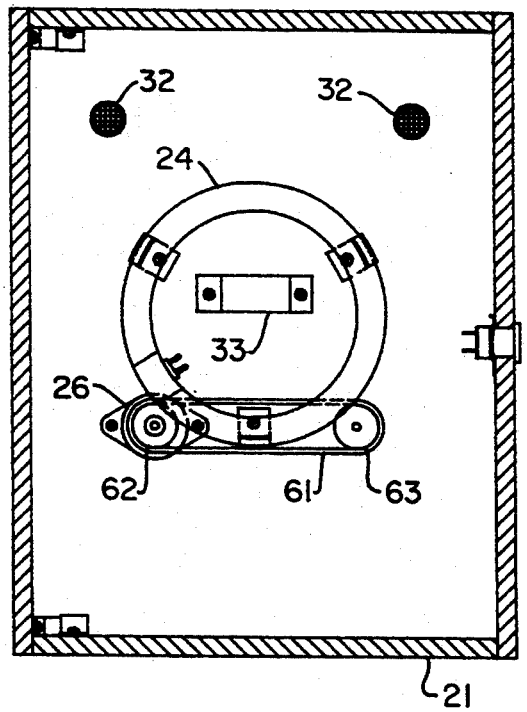
FIG. 18 is a cross-sectional view taken on the line 18—18 in FIG. 11.
Figure 17:
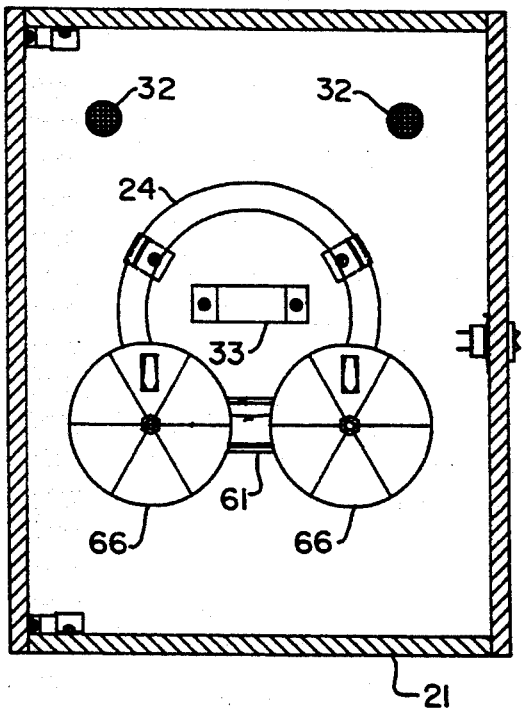
FIG. 17 is a cross-sectional view taken on the line 17–17 in FIG. 11.
Figure 19:
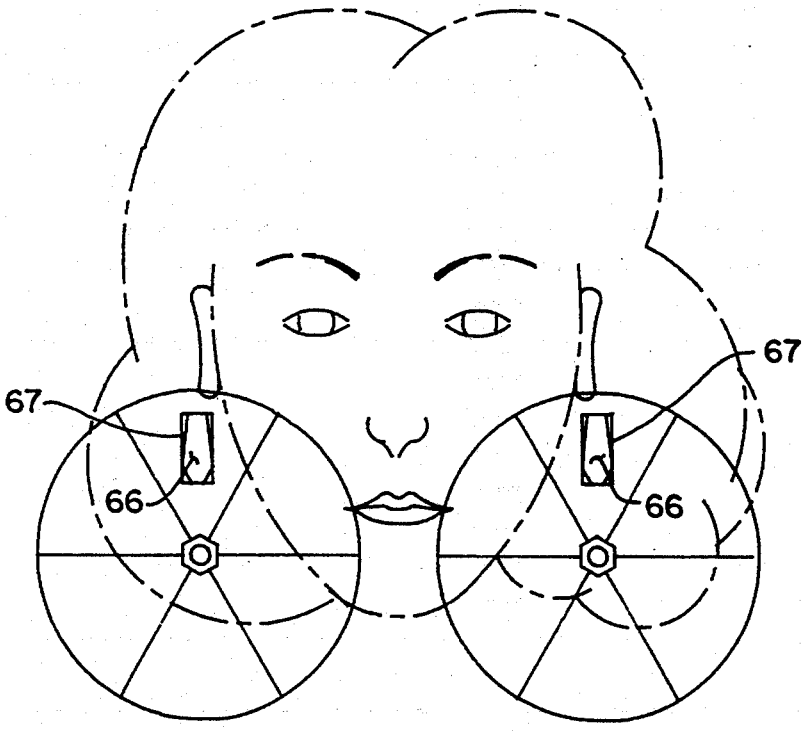
FIG. 19 is an enlarged view of the filter disk, light conducting element and the image of the woman of the embodiment shown in FIGS. 15 through 18.

The shape of the light conducting element 55 for this embodiment 51 is best seen in FIG. 14. It will be observed that for this embodiment 51 the outer end 56 of the light conducting element 55 at its attachment to the acrylic sheet 44 is shaped to conform to the outline of the woman's lips 57.

In FIGS. 15 through 19, an embodiment 58 is shown for purposes of further illustrating the wide application of my invention wherein a pair of earrings 59 continuously undergo a color change. A pair of filter disks 60 are driven by the electric motor and a timing belt 61. The timing belt 61 is preferably a small resilient belt commonly referred to as a cog belt and is mounted on a pair of sprockets, one 62 of which is directly mounted to the motor 26 and the other 63 of which is mounted to a shaft 64. In a similar manner to the aforedescribed embodiments, the end portions 66 of elongated light conducting elements 67 are shaped to conform with the outlines of the earrings 59.

Thus it will be appreciated that numerous arrangements can be made by varying the positions and numbers of the filter disks for displaying a variety of products such as jewelry, cosmetics, clothing and other articles of personal adornment.

Although only two embodiments of my invention have been illustrated and described, it is not my intention to limit my invention to these embodiments since other embodiments can be developed by changes in material, shape, arrangement and substitution of parts without departing from the spirit thereof.

I claim:

1. An electrically illuminated advertising display for continuously exhibiting articles of personal adornment in a range of colors, comprising: a housing, a light source mounted in an interior of said housing for projecting a beam of light on to an image of one of said articles of personal adornment on a translucent screen; said translucent screen forming a front portion of said housing, said translucent screen having an image of a person including one of said articles of personal adornment; at least one rotating disk interposed between said translucent screen and said light source, said rotating disk having an arrangement of filters for changing a color of said light beam which is projected by said light source, said filters being arranged on said disk to project said beam on the same portion of said screen; and at least one light conducting means interposed between said translucent screen and said rotating filter disk, said light conducting means having a shape for focusing and projecting said light beam on to said article of personal adornment included in said image of said person to continuously illuminate said article of personal adornment in said range of colors.

2. The advertising display recited in claim 1 wherein said light conducting means is a clear elongated plastic element.

3. The advertising display recited in claim 2 wherein said light conducting means has one end portion joined to said translucent screen.

4. The advertising display recited in claim 1 wherein said translucent screen is comprised of an outer thin sheet of photographic film having a white translucent base layer.

5. The advertising display recited in claim 4 further comprising a thin clear plastic sheet which is contiguous with the front surface of said photographic film and a thin plastic sheet which is contiguous with the rear surface of said photographic film.

6. The advertising display recited in claim 1 wherein said display is adapted to continuously exhibit contact lenses in said range of colors.

7. The advertising display recited in claim 1 wherein said display is adapted to continuously exhibit cosmetics in said range of colors.

8. An electrically illuminated advertising display for continuously exhibiting articles of personal adornment in a range of colors, comprising: a housing, a light source mounted in an interior of said housing for transmitting a light beam on to said transluscent screen; said translucent screen forming a front portion of said housing, said screen having an image of a person including one of said articles of personal adornment; at least one rotating disk interposed between said translucent screen and said light source, said rotating disk having an arrangement of filters for varying the color of the light beam which is transmitted by said light source, said filters being arranged on said disk to project said light beam on to the same portion of said screen; and at least one light conducting element interposed between said translucent screen and said rotating disk for focusing and projecting said light beam in said range of colors on to only said article of adornment in said image of said person on said translucent screen; and a means for continuously rotating said disk to continuously project light in said range of colors on to said translucent screen, said means for rotating said disk comprising a drive motor fixed to said housing and a resilient belt operatively connected to said drive motor and said disk.

9. The advertising display recited in claim 8 wherein said light source is a fluorescent light.

10. The advertising display recited in claim 8 wherein said display has a pair of light conducting means.

11. An electrically illuminated advertising display for continuously exhibiting articles of personal adornment in a range of colors, comprising: a housing, a light source mounted in an interior of said housing for projecting a light beam on to said translucent screen; a translucent screen forming a front portion of said housing, said translucent screen comprising an outer thin photographic film having a translucent base layer for diffusing said light beam through said photographic film and including an image of a person having one of said articles of adornment; at least one rotatable disk interposed between said translucent screen and said light source, said rotating disk having an arrangement of filters for varying the color of the light beam which is transmitted to said photographic film by said light source; and at least one light conducting element interposed between said translucent screen and said rotating disk, said light conducting element having one end portion adjacent to said photographic film having a shape which corresponds to said article of adornment in said image of said person on said photographic film.

12. The advertising display recited in claim 11 wherein said personal article of adornment in said image of said person is a pair of contact lenses and said arrangement of filters on said rotating disk is comprised of four equally angular spaced identical groups of filters, each of said groups consisting of four colors and said filters arranged on said disk to illuminate said contact lenses only with said range of colors.

* * * * *